United States Patent [19]

Yokoi et al.

[11] Patent Number: 4,874,262

[45] Date of Patent: Oct. 17, 1989

[54] PRINTER HAVING PIVOTABLE RIBBON GUIDE

[75] Inventors: Takeshi Yokoi, Kakamigahara; Shigeo Nakamura, Kasugai, both of Japan

[73] Assignee: Brother Kogyo Kabushiki Kaisha, Nagoya, Japan

[21] Appl. No.: 181,155

[22] Filed: Apr. 13, 1988

[30] Foreign Application Priority Data

Apr. 15, 1987 [JP] Japan ..... 62-94078

[51] Int. Cl.[4] ..... B41J 35/16

[52] U.S. Cl. ..... 400/216.1; 400/196; 400/208; 400/235.1; 400/248; 400/229

[58] Field of Search ..... 400/194, 195, 196, 196.1, 400/207, 208, 208.1, 211, 212, 215, 216, 216.1, 216.2, 235, 235.1, 240.2, 240.4, 248, 201, 202.4, 229, 320, 354

[56] References Cited

U.S. PATENT DOCUMENTS

| | | | |
|---|---|---|---|
| 2,005,503 | 6/1935 | Pelton | 400/201 |
| 3,900,099 | 8/1975 | Hengelhaupt | 400/215 |
| 4,526,487 | 7/1985 | Ikeda | 400/201 |
| 4,569,606 | 2/1986 | Hoyes | 400/208 |
| 4,650,355 | 3/1987 | Cassiano et al. | 400/216.1 |
| 4,695,175 | 9/1987 | Tsukada et al. | 400/196.1 |
| 4,773,777 | 9/1988 | Gomoll et al. | 400/216.1 |

FOREIGN PATENT DOCUMENTS

| | | | |
|---|---|---|---|
| 236776 | 9/1987 | European Pat. Off. | 400/195 |
| 219082 | 12/1983 | Japan | 400/208 |
| 73986 | 4/1984 | Japan | 400/216.2 |
| 137681 | 7/1985 | Japan | 400/216.1 |
| 54974 | 3/1986 | Japan | 400/215 |
| 137766 | 6/1986 | Japan | 400/212 |
| 175071 | 6/1986 | Japan . | |

OTHER PUBLICATIONS

P.A. Brumbaugh et al., "Printer Ribbon Cazette", *IBM Tech. Disc. Bull.*, vol. 19, No. 8, pp. 2978–2979, 400/196, Jan. 1977.

*Primary Examiner*—David A. Wiecking
*Attorney, Agent, or Firm*—Oliff & Berridge

[57] ABSTRACT

A printer including a first and a second guide shaft which extend parallel to an elongate platen, to slidably support a carriage on which a print head is mounted. The second guide shaft is spaced by a greater distance away from the platen than the first guide shaft. An active length of a print ribbon is exposed outside a container of a ribbon cassette. A ribbon guide is supported by the second guide shaft pivotally about an axis of the second guide shaft, for supporting the active length of the ribbon so as to pass between the platen and the print head. The ribbon guide is pivoted by drive means, so that the active length of the print ribbon is moved relative to the print head and the platen, in a direction perpendicular to a longitudinal direction of the platen.

24 Claims, 7 Drawing Sheets

PRINTER HAVING PIVOTABLE RIBBON GUIDE

BACKGROUND OF THE INVENTION

1. Field of the Invention

The present invention relates to a printer, and more particularly to structure of a ribbon guide assembly for supporting and guiding an active portion of print ribbon exposed outside a ribbon container of a ribbon cassette, so as to extend between a platen and a print head.

2. Discussion of the Prior Art

In a printer, an exposed active length of a print ribbon is guided, so as to pass between the platen, and the print head for effecting a printing operation. While the printer is at rest, the active portion of the print ribbon is maintained at its lower rest or home position. When a printing operation is performed, the active portion of the ribbon is lifted so that a desired width portion or color stripe of the ribbon is placed in the printing position aligned with the print head.

For guiding the print ribbon as indicated above, a known printer uses a ribbon guide which is pivotally supprted by a support shaft which is provided on the carriage on which the print head is mounted. The ribbon guide is pivoted about the axis of the shaft, to thereby position the active portion of the ribbon in the vertical direction. This type of ribbon guide assembly requires an additional number of parts including the pivot shaft on the carriage.

In the above arrangement wherein the pivoting axis of the ribbon guide is located on the carriage, the radius of pivoting movement of the ribbon guide at the active portion of the ribbon is limited, since the carriage of the printer has a limited size. This limitation in the pivoting radius of the ribbon guide tends to cause some troubles such as creasing of the active portion of the ribbon between the ribbon cassette housing and the ribbon guide, or slackening of the ribbon, which adversely affects the printing operation.

SUMMARY OF THE INVENTION

It is therefore a first object of the present invention to provide a printer having a simple ribbon guide assembly which does not use an exclusive pivot shaft for a ribbon guide, and which permits precise positioning of the the print ribbon in the printing position by a pivoting movement of the ribbon guide.

It is a second object of the present invention to provide a printer wherein a ribbon guide has a sufficiently large radius of pivot, so that the active portion of the ribbon is guided along an arc having an accordingly large radius.

It is a third object of the present invention to provide a printer wherein a ribbon cassette is pivoted with the ribbon guide about a common pivot axis, so as to avoid creasing and/or excessive tension or slackening of the exposed active portion of the ribbon between the ribbon container of the cassette and the ribbon guide.

It is a fourth object of the present invention to provide a printer wherein a ribbon cassette has a sufficiently large radius of pivot, so that the active portion of the ribbon is moved along an arc having an accordingly large radius.

The first and second objects may be achieved according to the principle of the present invention, which provides a printer comprising: (a) a generally elongate platen supported at opposite ends thereof by a frame; (b) a first guide shaft and a second guide shaft which are supported at opposite ends thereof by the frame, so as to extend parallel to the platen, the second guide shaft being spaced by a greater distance away from the platen than the first guide shaft; (c) a carriage slidably supported by the first and second guide shafts, for movements along the platen; (d) a print head mounted on the carriage so as to face the platen; (e) a ribbon cassette including a ribbon, and a ribbon container which accommodates the print ribbon such that an active length of the ribbon is exposed outside the container; (f) a ribbon guide supported by the second guide shaft pivotally about an axis of the second guide shaft, for supporting the active length of the ribbon so as to pass between the platen and the print head; and (g) ribbon-guide drive means for pivoting the ribbon guide and thereby moving the active length of the print ribbon relative to the print head and the platen, in a direction perpendicular to a longitudinal direction of the platen.

In the printer of the present invention constructed as described above, the ribbon guide is pivoted by the ribbon-guide drive means, about the axis of the second guide shaft. Thus, the instant printer does not use an exclusive shaft as conventionally provided on the carriage, for pivotally supporting the ribbon guide. Namely, the second guide shaft which cooperates with the first guide shaft to slidably support the carriage is used to support the ribbon guide. Therefore, the ribbon guide assembly including the ribbon guide is simple in construction, and the number of parts of the assembly is comparatively reduced. Further, the pivoting movement of the ribbon guide permits accurate positioning of the active portion of the ribbon in the printing position aligned with the print head.

Further, since the ribbon guide is pivoted about the axis of the second guide shaft which is comparatively distant from the platen, the ribbon guide has a sufficiently large radius of pivot, whereby the active length of the print ribbon supported by the ribbon guide is guided along an arc having an accordingly large radius. Accordingly, the active length of the ribbon can be smoothly brought to the printing position between the platen and the print head, without an excessive amount of tension or slackening of the ribbon between the print head and the platen.

The third and fourth objects of the invention indicated above may be achieved according to one form of the invention, wherein the printer further comprises pivotally connecting means for connecting the ribbon container to the second guide shaft pivotally about the axis thereof, and engaging means for holding the ribbon guide and the ribbon container in engagement with each other, such that the ribbon guide and the ribbon container are pivoted as a unit about the axis of the second guide shaft.

In the above form of the invention, the ribbon container of the ribbon cassette is pivoted together with the ribbon guide, about a common axis, i.e., about the second guide shaft. Therefore, the ribbon guide and the active portion of the ribbon have the same radius of pivot, whereby the active portion of the ribbon is protected against otherwise possible creasing and/or excessive tension or slackening between the ribbon container and the ribbon guide.

In one feature of the above form of the invention, the pivotally connecting means comprises a pair of elastic engaging jaws each of which extends from the ribbon container in a cantilever manner. The pair of engaging jaws have respective free ends defining a gap therebetween which is smaller than an outside diameter of the second guide shaft. The jaws engage the second guide shaft such that the jaws are normally substantially immovable relative to the second guide shaft in a radial direction of the second guide shaft. The jaws are disengageable from the second guide shaft due to elastic deformation thereof.

According to one arrangement of the above feature of the invention, the ribbon container is immovable in a longitudinal direction of the platen, and is adapted to support the active length of the print ribbon so as to extend along the platen by a distance greater than a maximum length of printing by the print head. The ribbon guide is moved with the carriage, while supporting the active length of the print ribbon such that the active length is movable relative to the ribbon guide in the longitudinal direction. In this case, the engaging means may comprise a roll supported by the ribbon guide rotatably about an axis perpendicular to a direction of movement of the carraige, and biasing means for biasing the ribbon guide toward the ribbon container for holding the ribbon guide and the ribbon cassette in rolling contact with each other via the roll. Alternatively, the roll may be adapted to engage a guide groove which is formed in the ribbon container so as to extend in the direction of movement of the carriage. The roll engaging the guide groove is substantially immovable relative to the guide groove in a direction perpendicular to the direction of movement.

According to another feature of the above form of the invention wherein the pivotally connecting means and the engaging means are provided, the printer further comprises a ribbon feed roll disposed within the ribbon container for feeding the print ribbon, a cassette holder supported by the second guide shaft pivotally about the axis thereof and disposed under the ribbon cassette to support the ribbon cassette mounted thereon, and ribbon drive means for rotating the ribbon feed roll. The ribbon drive means is disposed on the cassette holder, and is removably engageable with the ribbon feed roll when the ribbon cassette is mounted in position on the ribbon holder.

In one form of the above feature of the invention, the ribbon-guide drive means comprises an electric motor, a rotating member rotated by the electric motor, and connecting means for connecting the cassette holder to an eccentric portion of the rotating member. In this case, the casstte holder is pivoted about the axis of the second guide shaft and the ribbon casstte is consequently pivoted, whereby the ribbon guide engaging the ribbon cassette via the engaging means is pivoted about the axis.

In one arrangement of the above form of the invention, the ribbon-guide drive means further comprises a first gear rotated by the electric motor, a second gear having a non-toothed portion, rotatable with the rotating member and engaging the first gear, a spring lug having a fixed end which is immovable relative to the second gear, and a free end which extends in a radial direction of the second gear, and a stop disposed immovably relative to the frame. In this case, the stop is positioned so that the non-toothed portion of the second gear is aligned with the first gear while the spring lug is elastically deformed in engagement with the stop after the second gear is rotated in one direction.

According to another form of the present invention, the printer further comprises a head ribbon guide which is disposed so as to surround a nose portion of the print head adjacent to the platen. The head ribbon guide has a guiding surface opposite to the platen. The guiding surface consists of a part of a circumference of a cylinder having an axis on the axis of the second guide shaft.

According to a further form of the invention, the print ribbon has a plurality of width portions of different colors extending parallel to each other in a longitudinal direction thereof, and the ribbon guide comprises a ribbon guide roll rotatable about an axis perpendicular to a direction of movement of the carriage. The ribbon guide roll havs an outer circumferential surface for guiding the print ribbon. The circumferential surface has a plurality of annular grooves formed in alignment with respective boundaries of the plurality of width portions, so that the boundaries are free from contact with the circumferential surface.

According to a still further form of the invention, the ribbon guide comprises: a ribbon guide roll having a center bore, and a pair of counterbores formed in opposite end faces thereof in alignment with the center bore; a support body connected to the second guide shaft pivotally about the axis thereof; a support pin extending from the support body in a direction perpendicular to a direction of movement of the carriage; and an auxiliary support frame removably mounted on the support body and including a pair of spaced-apart support ears and a pair of bosses formed on opposite surfaces of the support ears, The support ears and the bosses have holes formed therethrough so that the support pin extends through the holes. In this case, the pair of bosses of the auxiliary support frame engage the counterbores of the ribbon guide roll and thereby prevent the ribbon guide roll from being disengaged from the auxiliary support frame before the auxiliary support frame is mounted on the support body. The support pin engages the center bore of the ribbon guide roll and thereby rotatably supports the ribbon guide roll, such that outer circumferential surfaces of the bosses are spaced apart from corresponding inner circumferential surfaces of the counterbores, after the auxiliary support frame is mounted on the support body.

According to another aspect of the invention, there is provided a ribbon cassette adapted to be mounted on a printer and including a container and a print ribbon, the container having an outlet and an inlet which are spaced apart from each other, and the print ribbon being accommodated within the container, except for an exposed active length thereof which extends between the outlet and the inlet, wherein the container has at least one engaging portion engageable with a shaft of the printer which extends substantially parallel to a straight line connecting the outlet and inlet. Each of the at least one engaging portion extends from the container in a cantilever manner, and includes a pair of elastic jaws which have respective free ends defining a gap therebetween which is smaller than an outside diameter of the shaft. The jaws are elastically yieldable, for engagement with the shaft such that the jaws are substantially immovable relative to the shaft in a radial direction of the shaft.

According to one form of the ribbon cassette of the present invention, the container includes a body accommodating a substantial length of the print ribbon, and a pair of hollow arms which extend from the body parallel to each other. The hollow arms have the outlet and inlet at free ends thereof, respectively. The hollow arms extend from the body of the container in a direction opposite to that in which the elastic jaws extend. In this case, the hollow arms have a relatively large radius of pivot, since the ribbon container is pivoted at the elastic jaws remote from the hollow arms. Accordingly, the active portion of the ribbon extending between the hollow arms is moved along an arc having a relatively large radius, and is consequently protected against otherwise possible creasing and/or excessive tension or slackening. Namely, the fourth object of the invention indicated above may be achieved according to this form of the ribbon cassette.

Another form of the ribbon cassette according to the invention further comprises an auxiliary member through which the exposed active length of the print ribbon extends between the outlet and the inlet. The auxiliary member has an engaging portion which is engageable with a body of a ribbon guide disposed in the printer such that the ribbon guide is movable perpendicular to an axis of the shaft. The auxiliary member is adapted to guide the active length of the ribbon while the engaging portion of the auxiliary member engages the body of the ribbon guide.

BRIEF DESCRIPTION OF THE DRAWINGS

The above and optional objects, features and advantages of the present invention will be better understood by reading the following detailed description of presently preferred embodiments of the invention, when considered in conjunction with the accompanying drawings, in which.

DETAILED DESCRIPTION OF THE PREFERRED EMBODIMENTS

Referring to FIGS. 1–9, a printer embodying the present invention will be described in detail.

Figure 1:
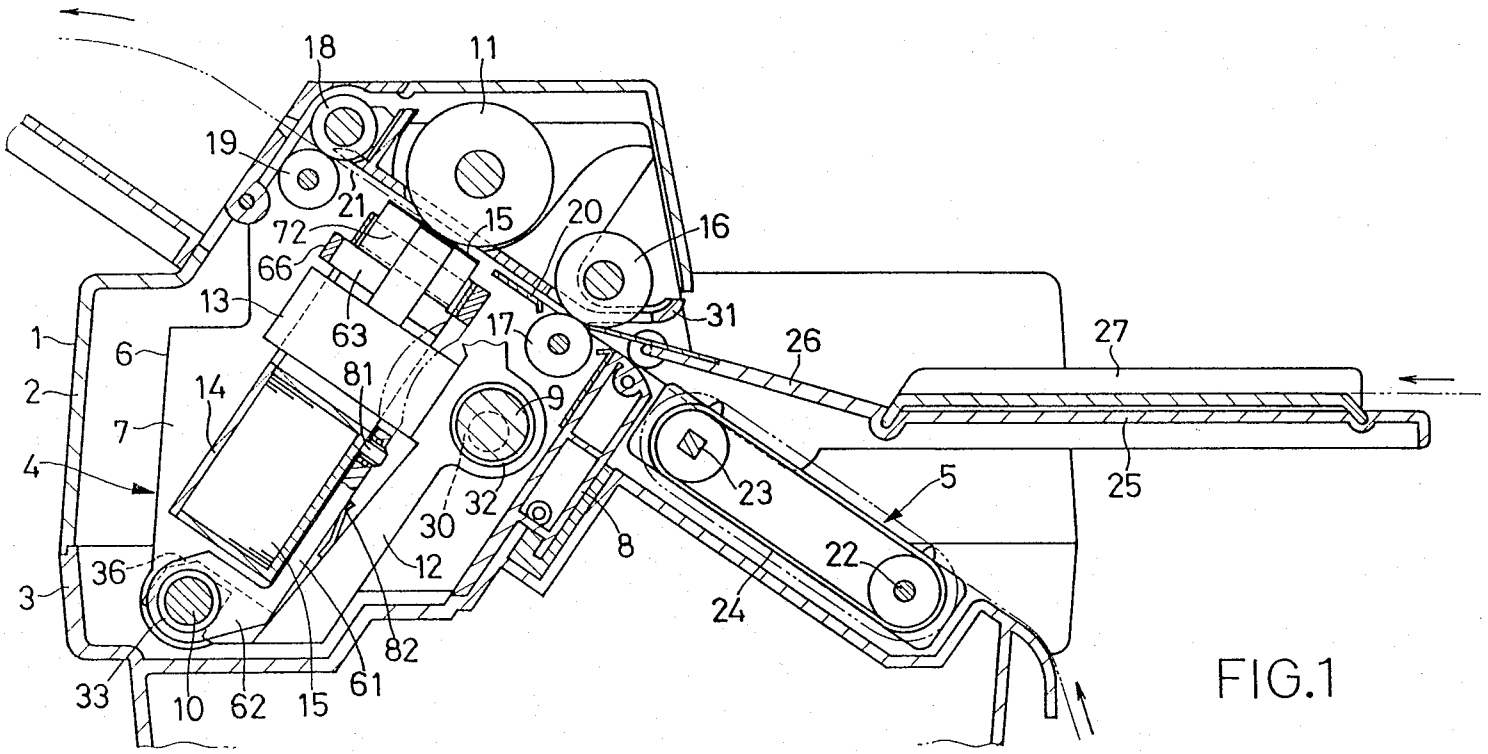
FIG. 1 is a fragmentary side elevational view in transverse cross section of one embodiment of a printer of the present invention.

As shown in FIG. 1, the printer has a housing 1 consisting of an upper casing 2 and a lower casing 3, which are connected together at a vertically intermediate portion of the housing. The printer housing 1 accommodates a printing unit 4 in its rear portion, and a tractor device 5 in its front portion. The printing unit 4 is mounted on a unit frame 6 which includes a pair of laterally spaced-apart side plates 7, a hollow bridging member 8, an upper, first guide shaft 9, and a lower, second guide shaft 10. Each of the first and second guide shafts 9, 10 takes the form of a round bar. The bridging member 8 and the guide shafts 9, 10 extend parallel to each other, so as to connect the side plates 7. Above the guide shafts 9, 10, there is disposed a cylindrical platen 11 which is rotatably supported by and between the side plates 7.

The printing unit 4 includes a carriage 12 which is supported on the first and second guide shafts 9, 10 slidably in the lateral direction of the printer or the longitudinal direction of the platen 11. The carriage 12 has a print head 13 mounted thereon such that the print head 13 extends obliquely toward the axis of the platen 11, from a lower left position with respect to the platen, so that the print head 13 faces the circumference of the platen 11. A ribbon container 14 accommodating a print ribbon 15 is disposed between the side plates 7 of the unit frame 6. An exposed active length of the print ribbon 15 supplied from the container 14 is exposed outside the housing of the container and is passed through a printing position between the platen 11 and the print head 13. A printing operation by the print head 13 is effected on a recording paper, via the print ribbon 15, while the carriage 12 is fed in the lateral direction of the printer.

The ribbon container 14 and the print ribbon 15 constitute a ribbon cassette which is pivotable as a unit, as described below.

The printer has four pairs of feed rolls 16, 17, 18 and 19. The feed rolls 16 and 17 are disposed upstream of the platen 11 as viewed in the feeding direction, while the feed rolls 18 and 19 are disposed downstream of the platen 11. The feed rolls 16 and 18 are positioned on one side of a line tangent to the circumference of the platen 11 at the printing position. The feed rolls 17 and 19 are positioned on the other side of the tangent line. The feed rolls 16, 17, 18, 19 are rotated with the platen 11, in a paper feeding direction, by a paper feed motor (not shown) via a suitable gear train (not shown), so that the recording paper is fed along a paper path 21 while being nipped by the rotating rolls 16, 17, 18, 19.

The paper path 21 which passes the printing station is defined by the nips of the feed rolls 16–19, and a lower paper guide 20 and an upper paper guide 31 which are disposed on both sides of the tangent line indicated above. The paper path 21 is substantially straight, and is inclined such that the paper-receiving end upstream of the printing position is lower than the paper-outgoing end downstream of the printing position.

The tractor device 5 includes a guide shaft 22 and a drive shaft 23 which extend in the lateral direction of the printer, and a pair of pin tractors 24 which are spaced apart from each other in the lateral direction. The pin tractors 24 are movable relative to each other to adjust the distance therebetween, depending upon the width of the paper. The pin tractors 24 have upper surfaces which are inclined so as to be flush with the inclined paper path 21. The upper surfaces of the pin tractors 24 disposed upstream of the paper path 21 in the feeding direction define a paper loading path for a paper web.

As in an ordinary pin tractor device, each of the left and right pin tractors 24 includes a pair of timing pulleys or wheels supported by the guide and drive shafts 22, 23, and an endless timing belt which connects the two timing wheels. The timing belt has a multiplicity of drive pins which are adapted to engage the perforations formed in the paper web. With the drive shaft 23 rotated by a drive motor (not shown), the pin tractor 24 is rotated, whereby the paper web is introduced into the paper path 21 leading to the printing position.

The printer is also equipped with a manual paper inserting guide 25 disposed above the tractor device 5. This guide 25 has an upper guide surface 26 and is supported between the side plates 7 of the unit frame 6, such that the guide surface 26 extends substantially horizontally and intersects the paper path 21 at a suitable angle. The inserting guide 25 is used to manually insert a cut sheet into the paper path 21 via the guide surface 26. The guide 25 has a pair of side plates 27 which are movable relative to each other in a direction perpendicular to the sheet inserting direction. When the cut sheet is inserted, the sheet is guided at its opposite edges by the side plates 27.

Figure 2:
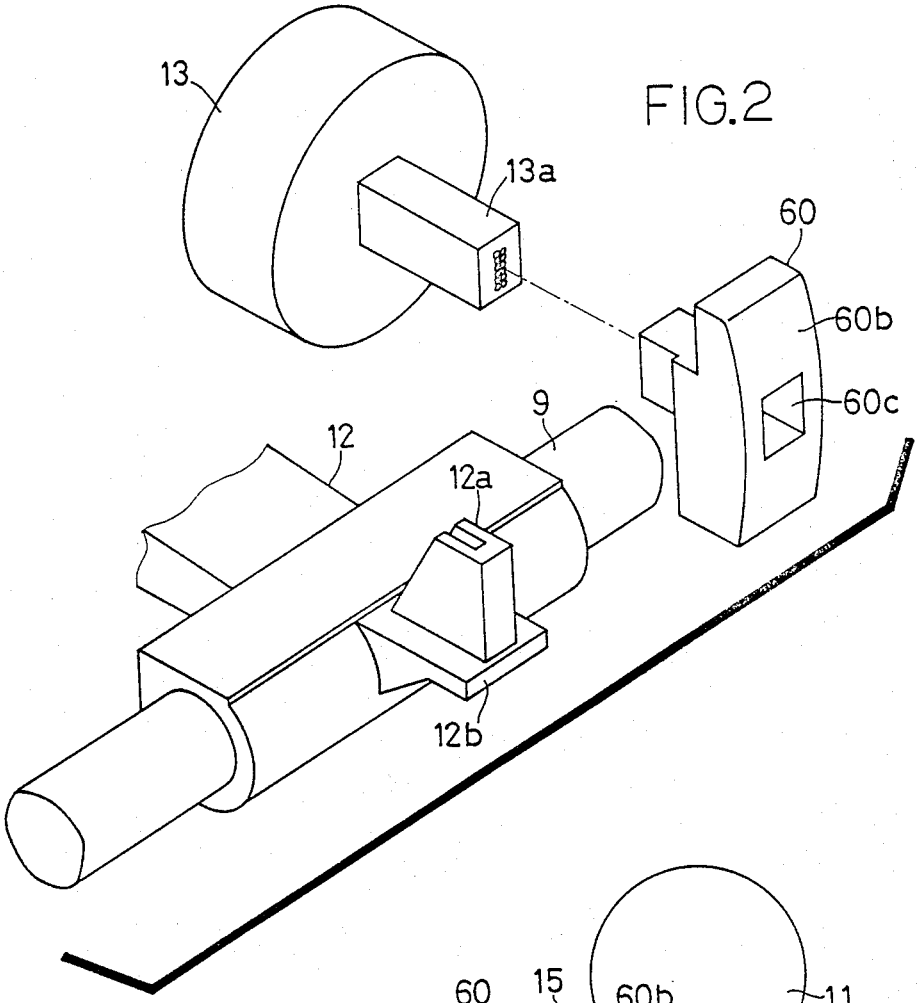
FIG. 2 is an exploded perspective view showning a portion of the printer in which a head ribbon guide is disposed.
Figure 3:
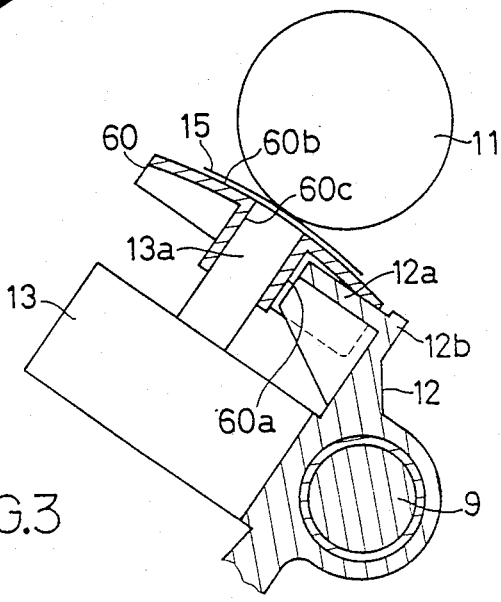
FIG. 3 is a side elevational view in cross section of the portion of the printer shown in FIG. 2.
Figure 4:
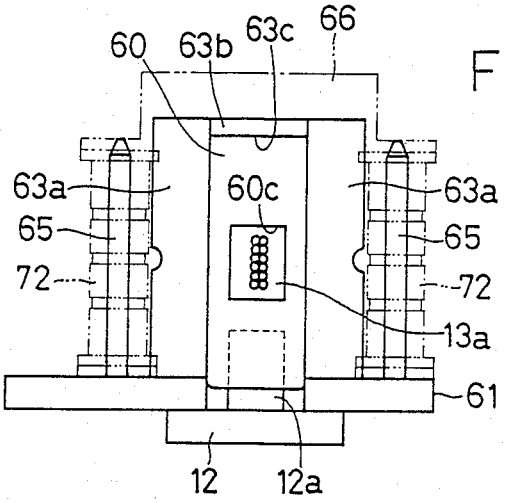
FIG. 4 is a front elevational view of the portion of the printer shown in FIG. 2.

Next, a structure for supporting the carriage 12 will be described in detail. As indicated in FIG. 1, the upper, first guide shaft 9 has opposite eccentric end portions 30, 30, at which the guide shaft 9 is supported by the side plates 7. Accordingly, the first guide shaft 9 is pivotable about the eccentric end portions 30. An upper section of the carriage 12 is fitted on this first guide shaft 9 via a sleeve 32 so that the carriage 12 is supported slidably in the printing direction parallel to the platen 11. As shown in FIGS. 2–4, the upper section of the carriage 12 which slidably engages the first guide shaft 9 has a laterally almost intermediate upper end portion **12*b* extending toward the platen 11. This upper end portion 12*b* has a protrusion 12*a* which extends toward a nose 13*a* of the print head 13. On this protrusion 12*a*, there is fixed a head ribbon guide 60** which will be described.

When the first guide shaft 9 is pivoted about its eccentric end portions 30 by a lever (not shown) secured to one end thereof, the axis of the first guide shaft 9 is displaced in a direction perpendicular to the printing direction (direction of movement of the carriage 12), whereby the carriage 12 can be moved toward and away from the platen 11 by pivoting the first guide shaft 9. Accordingly, the clearance between the print head 13 on the carriage 12 and the printing surface of the paper on the platen 11 can be maintained at a predetermined constant value, irrespective of the thickness of the paper, by changing the gap between the platen 11 and the print head 13, depending upon the varying thickness of the paper. Thus, printing operations on various papers having different thicknesses can be effected with a constant impact force of the print head 13.

Figure 5:
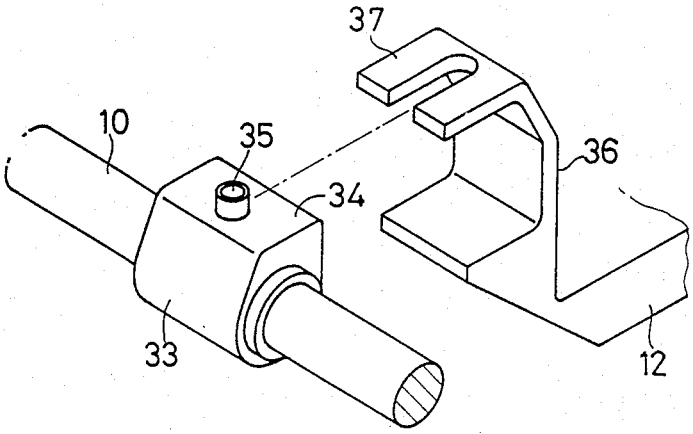
FIG. 5 is a fragmentary exploded perspective view, showing a portion of a carriage of the printer at which the carriage is supported by a second guide shaft.

As shown in FIGS. 1 and 5, the second guide shaft 10 located below the first guide shaft 9 is secured at its opposite ends to the respective side plates 7. On the second guide shaft 10 is fitted a sleeve 33 such that the sleeve 33 is slidable in the axial direction of the shaft 10. The outer circumference of the sleeve 33 has a flat bearing surface 34. A boss 35 in the form of a pin is formed in an almost central portion of the bearing surface 34. The lower section of the carriage 12 is formed with an arm 36 having a U shape in cross section. The arm 36 is adapted to engage the sleeve 33, and has a bifurcated slide portion 37 which slides on the bearing surface 34 and engages the boss 35. In this arrangement, the lower section of the carriage 12 is supported by the second guide shaft 10 via the sleeve 33 such that the carriage 12 is pivotable about the axis of the second guide shaft 10 and is slidable in the printing direction, and such that the lower section of the carriage 12 is connected to the sleeve 33 slidably in the direction perpendicular to the printing direction.

In the instant printer, therefore, the carriage 12 may be smoothly moved on the first and second guide shafts 9, 10 without a considerable twist or frictional resistance at its connections with the shafts 9, 10, even if the parallelism of the first and second guide shafts 9, 10 installed on the unit frame 6 is not sufficiently high. In this case, the carriage 12 is pivotable relative to the sleeve 33 on the second guide shaft 10, such that the slide portion 37 of the carriage is pivoted about the boss 35 on the sleeve 33 as the carriage 12 is moved in the printing direction. Further, the slide portion 37 slides on the bearing surface 34 of the sleeve 33 while engaging the boss 35, when the first guide shaft 9 is pivoted about its eccentric end portions 30, with its centerline displaced in the direction perpendicular to the printing direction, to adjust the distance between the print head 13 and the platen 11, for maintaining the predetermined clearance between the print head 13 and the printing surface of the recording paper on the platen 11, irrespective of the thickness of the paper. Even after the carriage 12 is moved relative to the platen 11 for adjusting the distance between the print head 13 and the platen 11, the carriage 12 can be smoothly moved in the printing direction during a printing operation, since the slide portion 37 of the carriage 12 is pivotable about the boss 35 on the sleeve 33 even if the parallelism of the first and second guide shafts 9, 10 is not sufficiently high.

Figure 6:
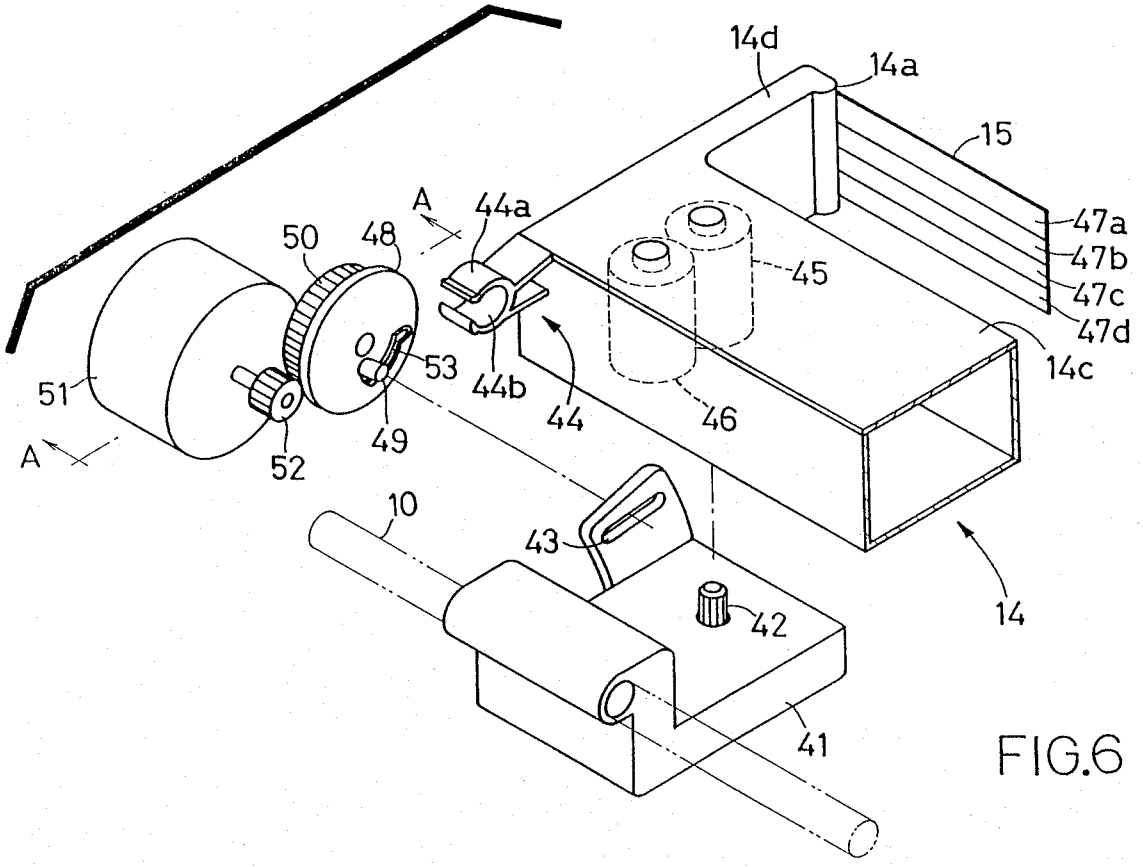
FIG. 6 is a fragmentary exploded perspective view of a ribbon cassette, and a structure for pivotally supporting the cassette.

There will be described a structure for supporting the ribbon cassette 14, 15. As shown in FIG. 1, the lower, second guide shaft 10 is disposed such that the print head 13 and the ribbon container 14 are positioned between the platen 11 and the second guide shaft 10. The second guide shaft 10 is spaced by a greater distance away from the platen 11 than the first guide shaft 9. As illustrated in FIG. 6, a cassette holder 41 is supported by the second guide shaft 10 pivotally in a vertical direction (as seen in FIG. 6). The cassette holder 41 has a drive sprocket 42 which extends from its upper surface and which is driven by a suitable motor (not shown). The cassette holder 41 further has an elongate hole 43 formed in a side portion remote from the second guide shaft 10.

The ribbon container 14 accommodating the print ribbon 15 has a pair of engaging portions 44 (one of which is shown in FIG. 6) formed at the opposite longitudinal ends, such that the engaging portions 44 extend in a cantilever manner from the lower surface of the container 14 (when installed in position as shown in FIG. 1). The ribbon container 14 is mounted on the cassette holder 41 such that the engaging portions 44 are removably fitted on the second guide shaft 10. Described more specifically, each of the engaging portions 44 has a pair of elastic jaws **44*a*, 44*b* which have respective free ends that define an opening therebetween which is smaller than the outside diameter of the second guide shaft 10. However, the elastic jaws 44*a*, 44*b* are elastically yieldable away from each other, whereby the engaging portion 44 can be fitted on the second guide shaft 10. With the engaging portions 44 fitted on the second guide shaft 10, the ribbon container 14 is immovable relative to the second guide shaft 10 in the radial direction of this shaft 10, but is pivotable about the shaft 10, together with the cassette holder 41**.

Figure 9:
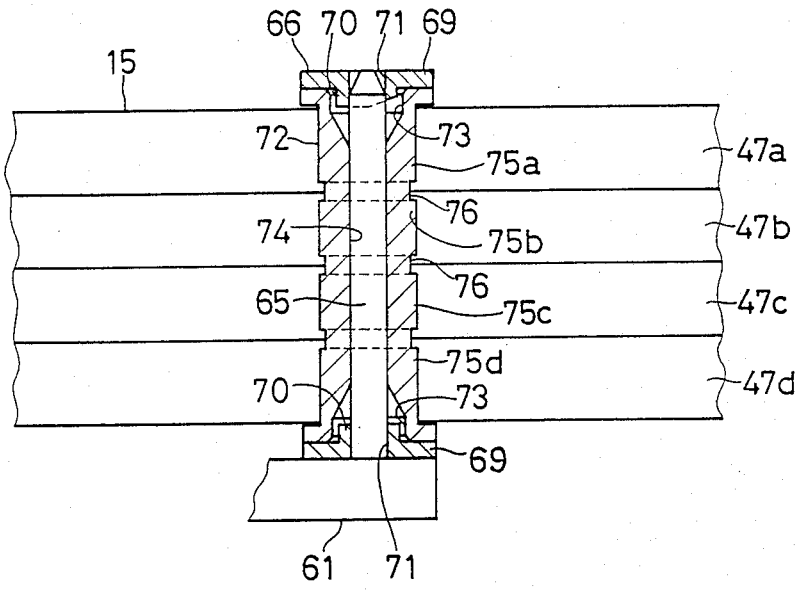
FIG. 9 is an enlarged fragmentary view in cross section of a ribbon guide roll positioned on a support frame.
Figure 10:
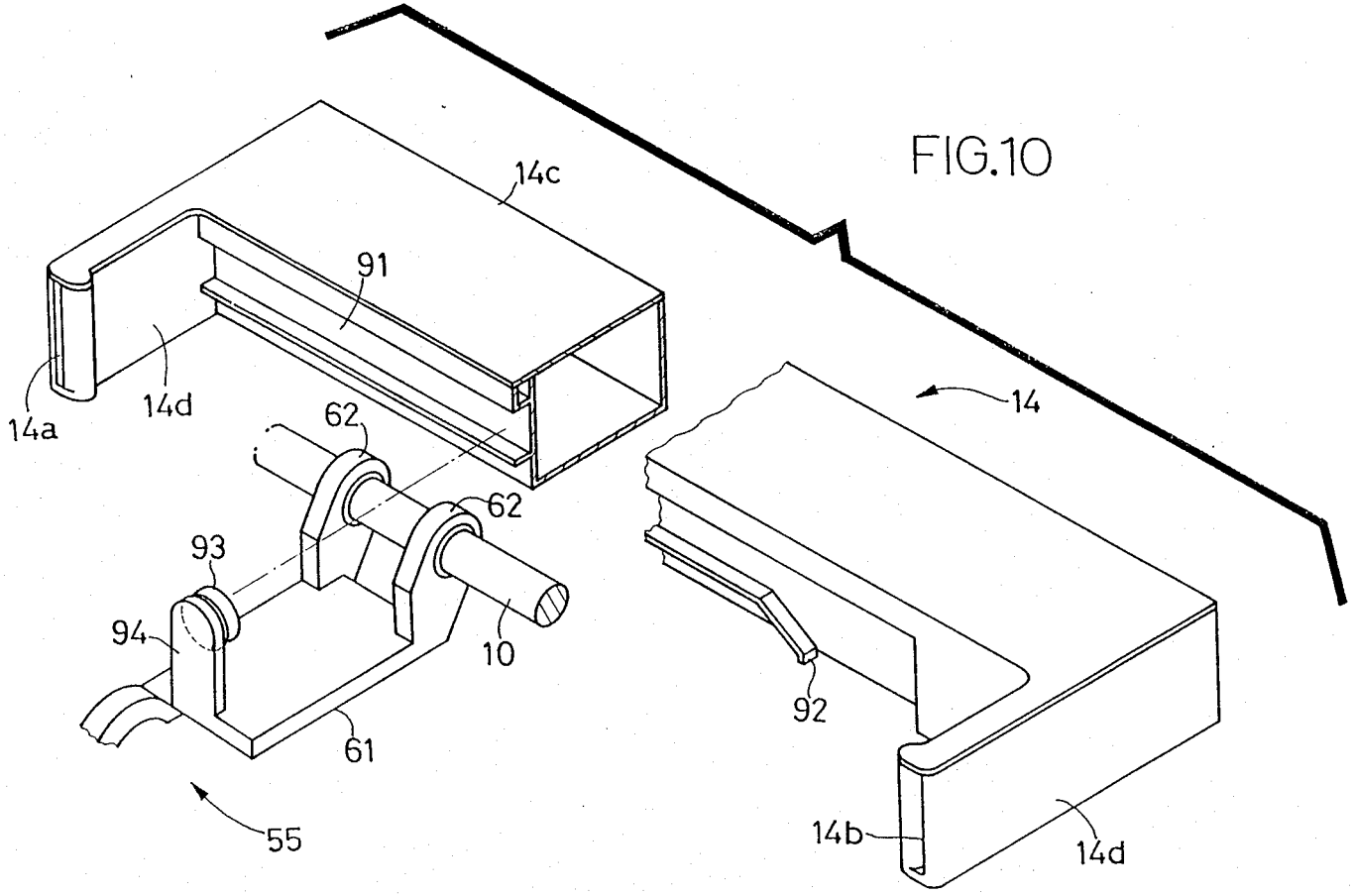
FIG. 10 is a fragmentary exploded perspective view of a modified arrangement for connecting the ribbon guide assembly and the ribbon cassette.

The ribbon container 14 has a body 14c extending in the printing direction, and a pair of parallel hollow arms 14d which extend from the opposite longitudinal ends of the body 14c toward the platen 11, in a direction opposite to the direction in which the engaging portions 44 extend. The body 14c accommodates the print ribbon 15, except for the exposed active length which extends between an outlet 14a (shown in FIG. 6) and an inlet 14b (as shown in FIG. 10 illustrating a modified ribbon container, which will be described). The outlet and inlet 14a, 14b consist of openings at the free ends of the respective hollow arms 14d. Within the body 14c of the container 14, there are disposed a drive feed roll 45 engageable with the drive sprocket 42 on the cassette holder 41, and a driven feed roll 46 rotated with the drive feed roll 45 in pressed rolling contact with each other. As indicated in FIGS. 6 and 9, the print ribbon 15 used in the instant printer is a multiple-color ribbon having four differently colored width portions 47a, 47b, 47c and 47d which extend parallel to each other in the longitudinal direction of the ribbon. That is, the ribbon 15 has a black stripe 47a, a blue stripe 47b, a red stripe 47c and a yellow stripe 47d, which are arranged in the direction of width of the ribbon.

Figure 7:
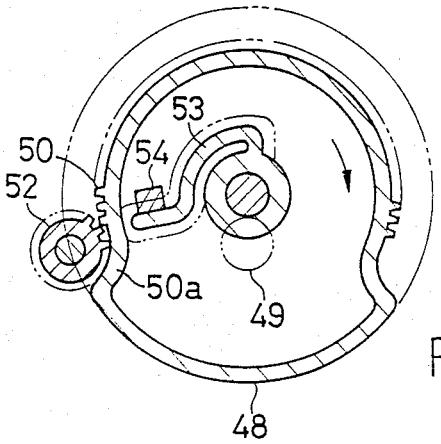
FIG. 7 is an enlarged fragmentary view in cross section taken along line A—A of FIG. 6.

The cassette holder 41 is pivoted about the second guide shaft 10 by a rotating disk 48 as shown in FIGS. 6 and 7. Described in greater detail, the rotating disk 48 is rotatably supported by one of the side plates 7 of the unit frame 6, and has an eccentric pin 49 formed at a position away from the axis of rotation. The eccentric pin 49 engages the elongate hole 43 formed in the cassette holder 41. The outer circumferential surface of the disk 48 includes a toothed portion or driven gear 50 formed over a suitable angular range, and a non-toothed portion 50a adjacent to the toothed portion 50. The driven gear 50 meshes with a drive gear 52 secured to an output shaft of a ribbon lift motor in the form of a stepper motor 51 mounted on the side plate 7 by which the disk 48 is supported. With the disk 48 rotated by the ribbon lift motor 51 through a selected angle, the eccentric pin 49 engaging the elongate hole 43 of the cassette holder 41 slidably moves in the hole 43, causing the cassette holder 41 to be pivoted about the axis of the second guide shaft 10, whereby the ribbon cassette 14, 15 mounted on the holder 41 is pivoted selectively to one of four operative positions corresponding to four width portions 47a–47d of the print ribbon 15.

The rotating disk 48 has an integrally formed spring lug 53 which has a fixed end immovable relative to the driven gear 50, and a free end portion extending in the radial direction of the driven gear 50. On the other hand, the side plate 7 by which the disk 48 is supported has a stop 54 which is positioned on a path taken by the free end of the lug 53 during rotation of the disk 48. When the drive gear 52 is rotated by the stepper motor 51 in the counterclockwise direction as seen in FIG. 7, the disk 48 is rotated in the clockwise direction until the two gears 50, 52 are disengaged from each other, i.e., until the non-toothed portion 50a is aligned with the drive gear 50. In this condition, the spring lug 53 is elastically deformed due to abutting contact of the lug with the stop 54. When the stepper motor 51 is turned off and the rotation of the drive gear 52 is stopped, the disk 48 is rotated through a small angle by an elastic force of the spring lug 53, in the counterclockwise direction, whereby the driven and drive gears 50, 52 are brought to their initial position in which the engagement of the two gears is commenced. In this position, the ribbon cassette 14, 15 is placed in the lowest home position. With the stepper motor 51 operated by appropriate amounts, the rotating disk 48 is rotated in the counterclockwise direction through the corresponding angles, whereby the ribbon cassette 14, 15 is pivoted about the second guide shaft 10, by the corresponding angles, together with the cassette holder 41. Thus, the differently colored width portions 47a, 47b, 47c and 47d of the print ribbon 15 can be selectively brought to the printing position aligned with the print head 13.

Then, an arrangement for guiding the active length of the print ribbon 15 will be described. The nose 13a of the print head 13 is received in a head ribbon guide 60, as illustrated in FIGS. 2–4. The head ribbon guide 60 includes a base portion having a hole 60a which engages the protrusion 12a extending from the upper section of the carriage 12. The head ribbon guide 60 has a guide portion extending from the front end of the base portion, in the pivoting direction of the ribbon cassette 14. This guide portion has an arcuate or part-cylindrical ribbon guiding surface 60b which has a curvature substantially equal to that of a cylinder having a centerline on the axis of the second guide shaft 10. The head ribbon guide 60 further has an opening 60c in which the nose 13a of the print head 13 is accommodated. In assembling the print head 13 and the head ribbon guide 60, the print head 13 with the guide 60 fitted on the nose 13a is mounted on the upper section of the carriage 12, such that the nose 13a is received in the hole 60a of the guide 60. Thus, the print head 13 and the guide 60 are positioned in place on the carriage 12. Since the front face of the nose 13a of the print head 13 is substantially flush with the ribbon guiding surface 60b of the guide 60, the exposed active portion of the ribbon 15 may be smoothly guided on the guiding surface 60b, without being caught or disturbed by the edges of the nose 13a, when the ribbon cassette 14 is pivoted. Further, the head ribbon guide 60, which is secured to the carriage 12 via the protrusion 12a, reduces a lateral force which is exerted on the nose 13a of the print head 13 from a ribbon guide assembly 55 (which will be described referring to FIG. 8), when the ribbon guide assembly 55 is reciprocated with the carriage 12 in the printing direction.

Figure 8:
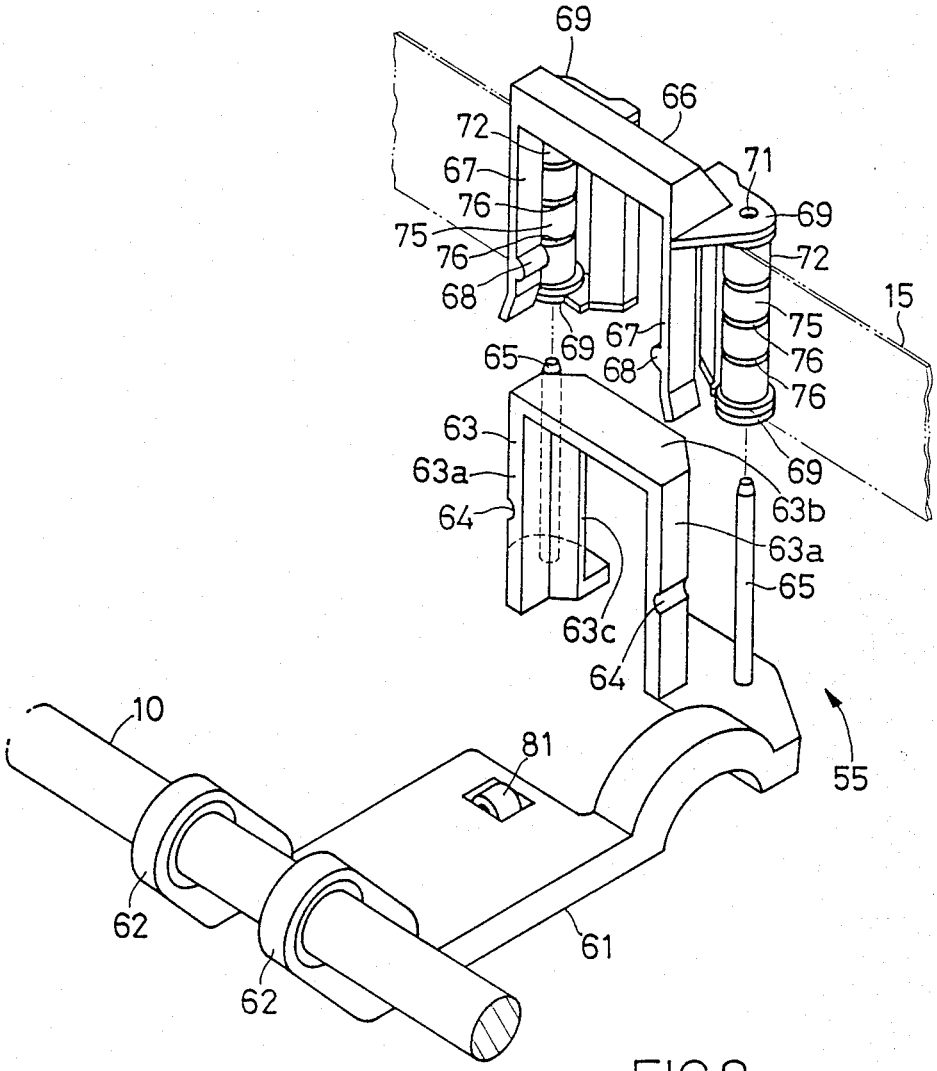
FIG. 8 is a fragmentary elevational view in perspective of a guide assembly for a print ribbon.

The ribbon guide assembly 55 is shown in FIG. 8. The assembly 55 includes a support body 61 formed of a synthetic resin. As indicated in FIGS. 1 and 8, the support body 61 has two arm portions 62 at its fixed end, and is supported at these arm portions by the second guide shaft 10, such that the support body 61 is pivotable about the axis of the second guide shaft 10. The support body 61 is fixed to the carriage 12, with the arm portions 62 sandwiching the sleeve 33 which is slidably fitted on the second guide shaft 10 and which slidably engages the arm 36 of the carriage 12. Thus, the carriage 12 and the support body 61 are moved as a unit in the printing direction. The support body 61 carries an attaching portion 63 formed at its free end. The attaching portion 63 consists of a pair of side legs 63a, and a connecting part 63b which connects the side legs 63a such that the legs and connecting part 63a, 63b cooperate to form an inverted U shape having an opening 63c. The attaching portion 63 is positioned and dimensioned so that the head ribbon guide 60 described above is partially received in the opening 63c. The side legs 63a of the attaching portion 63 have grooves 64 formed in the outer surfaces. The support body 61 also carries a pair of support pins 65 fixed at its free end. The support pins 65 are made of a metal, and are spaced apart from each other in the printing direction by a distance greater than the distance between the side legs 63*a* of the attaching portion 63. The support pins 65 are positioned on the opposite sides of the nose 13*a* of the print head 13.

As shown in FIGS. 8 and 9, an auxiliary support frame 66 formed of a synthetic resin is removably attached to the attaching portion 63 at the free end of the support body 61 of the ribbon guide assembly 55. More specifically, the auxiliary support frame 66 has a pair of elastic arms 67 which have respective tabs 68 on opposite inner surfaces. The support frame 66 is attached to the attaching portion 63 such that the tabs 68 are held in engagement with the respective grooves 64 of the attaching portion 63. The auxiliary support frame 66 is formed with two pairs of support ears 69 which laterally extend from the respective right and left elastic arms 67. The support ears 69 of each pair are spaced apart from each other along the length of the appropriate elastic arm 67, and have bosses 70 on the opposite inner surfaces. Holes 71 having substantially the same diameter as that of the support pins 65 are formed through the support ears 69, so as to extend the bosses 70.

A pair of ribbon guide rolls 72 are rotatably supported by and between the respective pairs of support ears 69, for supporting and guiding the exposed active length of the print ribbon 15 in parallel relationship with the platen 11. Each ribbon guide roll 72 has a small-diameter center bore 74 and large-diameter counterbores 73 formed at opposite ends of the center bore 74. The guide roll 72 is supported by the support ears 69 such that the bosses 70 are loosely fit in the respective counterbores 73. When the auxiliary support frame 66 is attached to the attaching portion 63 on the support body 61 as described above, the support pins 65 on the support body 61 are inserted through the holes 71 in the support ears 69 and the center bores 74 in the ribbon guide rolls 72. As a result, the guide rolls 72 are rotatably supported directly by the support pins 65, such that the outer circumferential surface of the bosses 70 is kept apart from the inner surface of the counterbores 73.

During a printing operation, the active portion of the print ribbon 15 is smoothly guided by the pair of ribbon guide rolls 74 disposed on both sides of the print head 13, so as to extend between the platen 11 and the nose 13*a* of the print head 13, parallel to the surface of the platen 11. The print ribbon 15 is smoothly fed relative to the print head 13, due to rotating movements of the ribbon guide rolls 72. In the instant embodiment, the ribbon guide rolls 72 are directly supported by the support pins 72, with the counterbored end portions 73 held in a spaced-apart relationship with the bosses 70 of the auxiliary support frame 66. That is, the contact of the guide rolls 72 with the support frame 66 occurs only between the opposite faces of the guide rolls 72 and the inner surfaces of the support ears 69 of the support frame 66. Therefore, the amount of friction between the rotating guide rolls 72 and the support frame 66 which are formed of a synthetic resin is considerably reduced, as compared with that where the guide rolls are supported by the bosses 70 only. Accordingly, the instant arrangement eliminates otherwise possible rattling movements of the guide rolls 72 due to excessive wear of the rolls 72 and support ears 69, and ribbon feeding troubles which would result from the wear due to an excessive amount of friction between the guide rolls 72 and the support ears 69 of the support frame 66.

As indicated in FIGS. 8 and 9, each of the ribbon guide rolls 72 has a plurality of annular grooves 76 formed in its outer circumferential surface 75, which serves as a guiding surface for supporting and guiding the exposed active length of the print ribbon 15. The annular grooves 76 are provided corresponding to the boundaries between the differently colored width portions 47*a*, 47*b*, 47*c* and 47*d* of the print ribbon 15. The grooves 76 divide the circumferential guiding surface 75 into four divisions 75*a*, 75*b*, 75*c* and 75*d*, which are spaced apart from each other in the axial direction of the guide roll 72. Each of the annular grooves 76 has a suitable width (dimension in the axial direction of the guide roll 72), so that each boundary of the width portions 47*a*–47*d* of the print ribbon 15 is aligned with the corresponding annular groove 76, even if the print ribbon 15 is displaced on the circumferential guiding surface 75 in the axial direction of the guide roll 72. Consequently, the annular grooves 76 prevent contacts between the boundaries of the width portions 47*a*–47*d* and the circumferential surface 75 of the guide roll 72. In other words, the individual width portions 47*a*–47*d* of the ribbon 15 are guided by the respective divisions 75*a*–75*d*, and any width portion 47*a*, 47*b*, 47*c*, 47*d* will not be guided by the adjacent two divisions of the guiding surface 75, when the ribbon 15 is fed during a printing operation. While each of the divisions 75*a*–75*d* of the guiding surface 75 is colored by the ink material of the corresponding width portion 47*a*, 47*b*, 47*c*, 47*d* of the ribbon 15, the ink material will not be transferred to the width portion 47*a*, 47*b*, 47*c*, 47*d* whose color is different from that of the ink material.

Next, means for connecting the ribbon guide assembly 55 and the ribbon container 14 will be described in detail. As shown in FIGS. 1 and 8, the support body 61 of the ribbon guide assembly 55 has a contact roll 81 rotatably supported in a central part of its upper surface. The contact roll 81 has an axis of rotation perpendicular to the printing direction or direction of movement of the carriage 12. On the other hand, the carriage 12 is provided with a sheet spring 82 which biases the support body 61 in a direction that causes the support body 61 to be pivoted in the counterclockwise direction as seen in FIG. 1, whereby the contact roll 81 is held in pressed contact with the surface of the ribbon container 14 that faces the support body 61. Consequently, the ribbon guide assembly 55 and the ribbon cassette 14, 15 are connected to each other via the contact roll 81, so that the assembly 55 and the cassette 14, 15 are pivotable as a unit about the axis of the second guide shaft 10, and so that ribbon guide assembly 55 and the carriage 12 are moved together with the contact roll 81 in rolling contact with the corresponding surface of the ribbion container 14, when the carriage 12 is moved in the printing direction.

In the present embodiment, when the ribbon cassette 14, 15 is pivoted about the second guide shaft 10 to the lowest home position, with the rotating disk 48 rotated in the clockwise direction (as seen in FIGS. 6 and 7) by the ribbon lift stepping motor 51, the ribbon guide assembly 55 is pivoted with the ribbon cassette 14, 15 about a common pivot shaft in the form of the second guide shaft 10, whereby the uppermost black width portion 47*a* of the ribbon 15 is brought to the printing position in front of the print head 13. From this home position, the ribbon cassette 14, 15 and the ribbon guide assembly 55 can be pivoted to a selected one of the upper three positions, together with the cassette holder 41, when the disk 48 is rotated through an appropriate angle by the stepper motor 51. Thus, the active portions of the blue, red and yellow width portions 47*b*, 47*c* and 47*d* of the ribbon 15 can be selectively brought to the printing position aligned with the print head 13, during a printing operation. Since the ribbon guide rolls 72 for supporting and guiding the active portion of the ribbon 15 are pivoted about the second guide shaft 10, the guide rolls 72 have a greater radius of pivoting movement, as compared with that where the guide rolls 72 are pivoted about a shaft disposed on the carriage 12. Consequently, the instant arrangement eliminates otherwise possible creasing or slackening of the active portion of the ribbon 15 due to the pivoting movement of the guide rolls 72.

Referring next to FIG. 10, there is shown a modified arrangement for connecting the ribbon guide assembly 55 and the ribbon container 14. In the interest of brevity and simplification, the same reference numerals as used in the preceding figures are used in FIG. 10, to identify the corresponding elements.

In this embodiment, the ribbon container 14 has a guide groove 91 formed on the front surface of the body 14*c*, so as to extend in the longitudinal direction, or direction of printing parallel to the platen 11. The guide groove 91 terminates with an open end 92 at one of its opposite ends. The groove 91 is open downwardly through this open end 92. The support body 61 of the ribbon guide assembly 55 has an extension 94 on which an engaging roll 93 is rotatably supported. When the ribbon cassette 14, 15 is installed while the carriage 12 and the ribbon guide assembly 55 are located at one end of the printing stroke, the engaging roll 93 may be brought into engagement with the guide groove 91 through the open end 92, so that the engaging roll 93 rolls on the body 14*c* of the ribbon container 14 when the carriage 12 and the ribbon guide assembly 55 are moved in the printing direction.

In the present modified embodiment, too, the ribbon guide assembly 55 and the ribbon cassette 14, 15 can be pivoted together as a unit, due to the rolling engagement of the engaging roll 93 and the guide groove 91, whereby the desired width portions 47*a*–47*d* of the print ribbon 15 of the cassette can be selectively brought into the printing position aligned with the print head 13.

While the present invention has been described in its presently preferred embodiments, it is to be understood that the invention is not limited to the details of the illustrated embodiments, but may be embodied with desired changes associated with the individual elements, which may occur without departing from the spirit of the present invention.

What is claimed is:

1. A printer comprising:

a generally enlongate platen supported at opposite ends thereof by a frame;

a first guide shaft and a second guide shaft which are supported at opposite ends thereof by said frame, so as to extend parallel to said platen, said second guide shaft being spaced by a greater distance away from said platen than said first guide shaft;

a carriage slidably supported by said first and second guide shafts, for movements along said platen;

a print head mounted on said carriage so as to face said platen;

a ribbon cassette including a ribbon, and a ribbon container which accommodates said print ribbon such that an active length of said ribbon is exposed outside said container;

a ribbon guide supported by said second guide shaft pivotally about a central longitudinal axis of second guide shaft, for supporting said active length of said ribbon so as to pass between said platen and said print head;

ribbon-guide drive means for pivoting said ribbon guide about said second guide shaft and thereby moving said active length of the print ribbon relative to said print head and said platen, in a direction perpendicular to a longitudinal direction of said platen.

2. A printer according to claim 1, further comprising:

pivotally connecting means for connecting said ribbon container to said second guide shaft pivotally about said central longitudinal axis thereof; and engaging means for holding said ribbon guide and said ribbon container in engagement with each other, such that said ribbon guide and said ribbon container are pivoted as a unit about the central longitudinal axis of said second guide shaft.

3. A printer according to claim 2, wherein said pivotally connecting means comprises a pair of elastic engaging jaws each of which extends from said ribbon container in a cantilever manner, said pair of engaging jaws having respective free ends defining a gap therebetween which is smaller than an outside diameter of said second guide shaft, said jaws engaging said second guide shaft such that said jaws are normally substantially immovable relative to said second guide shaft in a radial direction of said second guide shaft, said jaws being disengageable from said second guide shaft due to elastic deformation thereof.

4. A printer according to claim 3, wherein said ribbon container is immovable in a longitudinal direction of said platen and supports said active length of said print ribbon so as to extend along said platen by a distance greater than a maximum length of printing by said print head, and said ribbon guide is moved with said carriage, while supporting said active length of the print ribbon such that said active length is movable relative to said ribbon guide in the longitudinal direction.

5. A printer according to claim 4, wherein said engaging means comprises a roll supported by said ribbon guide rotatably about an axis perpendicular to a direction of movement of said carraige, and further comprises biasing means for biasing said ribbon guide toward said ribbon container for holding said ribbon guide and said ribbon cassette in rolling contact with each other via said roll.

6. A printer according to claim 4, wherein said engaging means comprises a roll supported by said ribbon guide rotatably about an axis perpendicular to a direction of movement of said carriage, and further comprises a guide groove which is formed in said ribbon container so as to extend in the direction of movement of said carriage, said roll engaging said guide groove such that said roll is substantially immovable relative to said guide groove in a direction perpendicular to said direction of movement.

7. A printer according to claim 2, further comprising:

a ribbon feed roll disposed within said ribbon container, for feeding said print ribbon;

a cassette holder supported by said second guide shaft pivotally about said central longitudinal axis thereof, and disposed under said ribbon cassette to support the ribbon cassette mounted thereon; and ribbon drive means for rotating said ribbon feed roll, said ribbon drive means being disposed on said cassette holder, and removably engageable with said ribbon feed roll when said ribbon cassette is mounted in position on said ribbon holder.

8. A printer according to claim 7, wherein said ribbon-guide drive means comprises:

an electric motor;

a rotating member rotated by said electric motor; and connecting means for connecting said cassette holder to an eccentric portion of said rotating member, and wherein said cassette holder is pivoted about the central longitudinal axis of said second guide shaft and said ribbon casstte is consequently pivoted, whereby said ribbon guide engaging said ribbon cassette via said engaging means is pivoted about said central longitudinal axis.

9. A printer according to claim 8, wherein said ribbon-guide drive means further comprises:

a first gear rotated by said electric motor;

a second gear rotatable with said rotating member, and engaging said first gear, said second gear having a non-toothed portion;

a spring lug having a fixed end which is immovable relative to said second gear, and a free end which extends in a radial direction of said second gear; and a stop disposed immovably relative to said frame, and wherein said stop is positioned so that said non-toothed portion of said second gear is aligned with said first gear while said spring lug is elastically deformed in engagement with said stop after said second gear is rotated in one direction.

10. A printer according to claim 1, further comprising a head ribbon guide which is disposed so as to surround a nose portion of said print head adjacent to said platen, said head ribbon guide having a guiding surface opposite to said platen, said guiding surface consisting of a part of a circumference of a cylinder having an axis on the axis of said central longitudinal second guide shaft.

11. A printer according to claim 1, wherein said print ribbon has a plurality of width portions of different colors extending parallel to each other in a longitudinal direction thereof, and said ribbon guide comprises a ribbon guide roll rotatable about an axis perpendicular to a direction of movement of the carriage, said ribbon guide roll having an outer circumferential surface for guiding said print ribbon, said circumferential surface having a plurality of annular grooves formed in alignment with respective boundaries of said plurality of width portions, so that said boundaries are free from contact with said circumferential surface.

12. A printer according to claim 1, wherein said ribbon guide comprises:

a ribbon guide roll having a center bore, and a pair of counterbores formed in opposite end faces thereof in alignment with said center bore;

a support body connected to said second guide shaft pivotally about said central longitudinal axis thereof;

a support pin extending from said support body in a direction perpendicular to a direction of movement of said carriage; and an auxiliary support frame removably mounted on said support body and including a pair of spaced-apart support ears and a pair of bosses formed on opposite surfaces of said support ears, said support ears and said bosses having holes formed therethrough so that said support pin extends through said holes, and wherein said pair of bosses of said auxiliary support frame engage said counterbores of said ribbon guide roll and thereby prevent said ribbon guide roll from being disengaged from said auxiliary support frame before the auxiliary support frame is mounted on said support body, said support pin engaging said center bore of said ribbon guide roll and thereby rotatably supporting said ribbon guide roll, such that outer circumferential surfaces of said bosses are spaced apart from corresponding inner circumferential surfaces of said counterbores, after said auxiliary support frame is mounted on said support body.

13. A ribbon cassette adapted to be mounted on a printer, and including a container and a print ribbon, said container having an outlet and an inlet which are spaced apart from each other, and said print ribbon being accommodated within said container, except for an exposed active length thereof which extends between said outlet and said inlet, wherein the improvement comprises:

said container having (a) a body accommodating a substantial length of said print ribbon, (b) a pair of hollow arms which extend from said body parallel to each other and which have said outlet and said inlet at free ends thereof, respectively, and (c) at least one engaging portion engagable with a shaft of the printer which extends substantially parallel to a straight line connecting said outlet and said inlet, each of said at least one engaging portion including a pair of elastic jaws which extend from said body in a cantilever manner in a direction opposite to that in which said hollow arms extend, said pair of elastic jaws having respective free ends defining a gap therebetween which is smaller than an outside diameter of said shaft, said pair of jaws being elastically yieldable away from each other when the jaws are brought into engagement with said shaft, said jaws in engagement with said shaft being substantially immovable relative to said shaft in a radial direction of said shaft.

14. A ribbon cassette according to claim 13, further comprising an auxiliary member through which said exposed active length of said print ribbon extends between said outlet and said inlet, said auxiliary member having an engaging portion which is engageable with a body of a ribbon guide disposed in the printer such that the ribbon guide is movable perpendicular to an axis of said shaft, said auxiliary member guiding said active length of said ribbon while said engaging portion of the auxiliary member engages said body of the ribbon guide.

15. A printer comprising:

a generally elongate platen supported at opposite ends thereof by a frame;

a carriage movable along said platen;

a print head mounted on said carriage so as to face said platen;

a ribbon cassette including a ribbon, and a ribbon container which accommodates said print ribbon such that an active length of said ribbon is exposed outside said container;

said ribbon container being immovable in a longitudinal direction of said platen and supporting said active length of said print ribbon so as to extend along said platen by a distance greater than a maximum length of printing by said print head;

a guide shaft which is supported at opposite ends thereof by said frame, so as to extend parallel to said platen;

a ribbon guide supported by said guide shaft pivotally about and slidably along a central longitudinal axis of the guide shaft, for supporting said active length of said ribbon so as to pass between said platen and said print head, said ribbon guide being moved with said carriage, while supporting said active length of the print ribbon such that said active length is movable relative to said ribbon guide in the longitudinal direction; and ribbon-guide drive means for pivoting said ribbon guide about said guide shaft and thereby moving said active length of the print ribbon relative to said print head and said platen, in a direction perpendicular to a longitudinal direction of said platen.

16. A printer according to claim 15, further comprising:

pivotally connecting means for connecting said ribbon container to said guide shaft pivotally about said central longitudinal axis thereof; and engaging means for holding said ribbon guide and said ribbon container in engagement with each other, such that said ribbon guide and said ribbon container are pivoted as a unit about said guide shaft, and are movable relative to each other in said longitudinal direction of said platen.

17. A printer comprising:

a generally elongate platen supported at opposite ends thereof by a frame;

a carriage slidably supported by a guide shaft, for movements along said platen;

a print head mounted on said carriage so as to face said platen;

a ribbon cassette including a ribbon, and a ribbon container which accommodates said print ribbon such that an active length of said ribbon is exposed outside said container;

said ribbon container being immovable in a longitudinal direction of said platen and supporting said active length of said print ribbon so as to extend along said platen by a distance greater than a maximum length of printing by said print head;

a ribbon guide for supporting said active length of said ribbon so as to pass between said platen and said print head, said ribbon guide being moved with said carriage, while said ribbon guide supports said active length of the print ribbon such that said active length is movable relative to said ribbon guide in the longitudinal direction;

pivotally supporting means for supporting said ribbon container pivotally about an axis parallel to said platen;

ribbon-container drive means for pivoting said ribbon container about said axis and thereby moving said active length of the print ribbon relative to said print head and said platen, in a direction perpendicular to a longitudinal direction of said platen;

a roll supported by said ribbon guide rotatably about an axis perpendicular to a direction of movement of said carriage;

holding means for holding said ribbon guide and said ribbon cassette in rolling contact with each other via said roll, such that said ribbon guide and said ribbon container are pivoted as a unit about the axis parallel to said platen.

18. A printer according to claim 17, wherein said holding means comprises biasing means for biasing said roll against said ribbon guide toward said ribbon container.

19. A printer according to claim 17, wherein said holding means comprises a guide groove which is formed in said ribbon container so as to extend in the direction of movement of said carriage, said roll engaging said guide groove such that said roll is substantially immovable relative to said guide groove in a direction perpendicular to said direction of movement.

20. A printer comprising:

a generally elongate platen supported at opposite ends thereof by a frame;

a carriage slidably supported by a guide shaft, for movements along said platen;

a print head mounted on said carriage so as to face said platen;

a ribbon guide pivotally supported about an axis parallel to said platen, for supporting a print ribbon so as to pass between said platen and said print head;

an electric motor;

a first gear rotated by said electric motor;

a second gear rotatable with a rotating member, and engaging said first gear, said second gear having a non-toothed portion;

a spring lug having a fixed end which is immovable relative to said second gear, and a free end which extends in a radial direction of said second gear;

a rotating member rotated by said second gear;

connecting means for connecting said ribbon guide to an eccentric portion of said rotating member, to pivot said ribbon guide about the axis parallel to said platen, when said electric motor is operated; and a stop disposed immovably relative to said frame, and positioned so that said non-toothed portion of said second gear is aligned with said first gear while said spring lug is elastically deformed in engagement with said stop after said second gear is rotated in one direction by said electric motor.

21. A printer according to claim 20, further comprising:

a ribbon cassette including a ribbon container which accommodates said print ribbon such that an active length of said ribbon is exposed outside said container;

pivotally supporting means for pivotally supporting said ribbon container about said axis parallel to said platen; and engaging means for holding said ribbon guide and said ribbon container in engagement with each other, such that said ribbon guide and said ribbon container are pivoted as a unit.

22. A printer according to claim 21, further comprising a cassette holder supported by said guide shaft pivotally about said axis thereof, and disposed under said ribbon cassette to support the ribbon cassette mounted thereon, said cassette holder being connected by said connecting means to said eccentric portion of said rotating member, said cassette holder being pivoted and said ribbon cassette being consequently pivoted, whereby said ribbon guide engaging said ribbon cassette via said engaging means is pivoted.

23. A printer comprising:

a generally elongate platen supported at opposite ends thereof by a frame;

a carriage slidably supported by a guide shaft parallel to said platen, for movements along said platen;

a print head mounted on said carriage so as to face said platen;

a ribbon cassette including a ribbon, and a ribbon container which accommodates said print ribbon such that an active length of said ribbon is exposed outside said container, said ribbon container being immovable in a longitudinal direction of said platen and supports said active length of said print ribbon so as to extend along said platen by a distance greater than a maximum length of printing by said print head; and a ribbon guide for supporting said active length of said ribbon so as to pass between said platen and said print head, said ribbon guide comprising (a) a ribbon guide roll having a center bore, and a pair of counterbores formed in opposite end faces thereof in alignment with said center bore, (b) a support body which is moved with said carriage, (c) a support pin extending from said support body in a direction perpendicular to a direction of movement of said carriage, and (d) an auxiliary support frame removably mounted on said support body and including a pair of spaced-apart support ears and a pair of bosses formed on opposite surfaces of said support ears, said support ears and said bosses having holes formed therethrough so that said support pin extends through said holes, said pair of bosses of said auxiliary support frame engaging said counterbores of said ribbon guide roll from being disengaged from said auxiliary support frame before the auxiliary support frame is mounted on said support body, said support pin engaging said center bore of said ribbon guide roll and thereby rotatably supporting said ribbon guide roll.

24. A printer according to claim 23, wherein said auxiliary support frame rotatably supports said ribbon guide roll, such that outer circumferential surfaces of said bosses are spaced apart from corresponding inner circumferential surfaces of said counterbores, after said auxiliary support frame is mounted on said support body.

* * * * *